US007614160B2

(12) United States Patent
Kameishi et al.

(10) Patent No.: US 7,614,160 B2
(45) Date of Patent: Nov. 10, 2009

(54) HAND DRYING APPARATUS

(75) Inventors: Keiji Kameishi, Tokyo (JP); Takaki Kobayashi, Tokyo (JP); Jun Nakamura, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 229 days.

(21) Appl. No.: 10/585,920

(22) PCT Filed: Aug. 18, 2005

(86) PCT No.: PCT/JP2005/015095

§ 371 (c)(1),
(2), (4) Date: Jul. 13, 2006

(87) PCT Pub. No.: WO2007/020699

PCT Pub. Date: Feb. 22, 2007

(65) Prior Publication Data

US 2008/0216342 A1 Sep. 11, 2008

(51) Int. Cl.
*F26B 7/00* (2006.01)

(52) U.S. Cl. ..... 34/90

(58) Field of Classification Search ..... 34/90, 34/100, 104, 201

See application file for complete search history.

(56) References Cited

U.S. PATENT DOCUMENTS 1,961,179 A * 6/1934 Tinkham ..... 34/202
2,022,593 A * 11/1935 Fuykers ..... 34/444
2,225,505 A * 12/1940 Offen ..... 34/465
2,634,514 A * 4/1953 Clemens ..... 34/202
2,853,591 A * 9/1958 Fine ..... 392/381
2,859,535 A * 11/1958 Carlson ..... 34/562
2,965,974 A * 12/1960 Jackson ..... 34/225
3,006,079 A * 10/1961 Jepson ..... 34/99

(Continued)

FOREIGN PATENT DOCUMENTS

JP 7-136078 5/1995

(Continued)

OTHER PUBLICATIONS

Singapore Search and Examination Report Application No. 200606007-3 dated Jan. 16, 2008, pp. 1-9.

*Primary Examiner*—Stephen M. Gravini
(74) *Attorney, Agent, or Firm*—Buchanan Ingersoll & Rooney PC

(57) ABSTRACT

A hand drying apparatus includes a main body box case 1 that has a hand inserting portion 3 formed in a concave shape at an upper portion; a high-pressure airflow generator 2 that generates high-pressure airflows and is included in the main body box case; and a front side air nozzle 6*a* and a back side air nozzle 6*b* that eject the high-pressure airflows generated by the high-pressure airflow generator 2 into the hand inserting portion 3 and face each other. The front side air nozzle 6*a* and the back side air nozzle 6*b* are formed by a plurality of slit-shaped ejecting holes 7 arranged in a line, respectively, and both or any one of lengths and arranging intervals of the slit-shaped ejecting holes 7 is different between a front side and a back side. A hand drying apparatus that can prevent noise and realize high drying performance and excellent usability without employing a complicated construction is obtained.

11 Claims, 6 Drawing Sheets

U.S. PATENT DOCUMENTS

| | | | | | |
|---|---|---|---|---|---|
| 3,131,281 | A | * | 4/1964 | Jepson | 392/383 |
| 3,603,002 | A | * | 9/1971 | Spierer | 34/202 |
| 3,643,346 | A | * | 2/1972 | Lester | 34/202 |
| 4,271,602 | A | * | 6/1981 | Grolms | 34/655 |
| 4,497,999 | A | * | 2/1985 | Postbeschild | 392/381 |
| 4,704,806 | A | * | 11/1987 | Gresens | 34/570 |
| 4,756,094 | A | * | 7/1988 | Houck, Jr. | 34/225 |
| 4,785,162 | A | * | 11/1988 | Kuo | 392/381 |
| 4,871,900 | A | * | 10/1989 | Hickman | 392/380 |
| 4,893,741 | A | * | 1/1990 | Heinzmann | 242/615 |
| 4,999,927 | A | * | 3/1991 | Durst et al. | 34/448 |
| 5,009,016 | A | * | 4/1991 | LePisto et al. | 34/421 |
| 5,351,417 | A | * | 10/1994 | Rubin | 34/90 |
| 5,438,763 | A | * | 8/1995 | Yang | 34/90 |
| 5,459,944 | A | * | 10/1995 | Tatsutani et al. | 34/202 |
| 5,568,691 | A | * | 10/1996 | Rubin | 34/98 |
| 5,640,781 | A | * | 6/1997 | Carson | 34/97 |
| 5,873,179 | A | * | 2/1999 | Gregory et al. | 34/90 |
| 6,021,584 | A | * | 2/2000 | Schwartz | 34/666 |
| 6,038,786 | A | * | 3/2000 | Aisenberg et al. | 34/267 |
| 6,079,118 | A | * | 6/2000 | Kiyokawa | 34/134 |
| 6,161,301 | A | * | 12/2000 | Hoshi et al. | 34/111 |
| 6,185,838 | B1 | * | 2/2001 | Moore | 34/202 |
| 6,269,552 | B1 | * | 8/2001 | Honda et al. | 34/317 |
| 6,651,356 | B1 | * | 11/2003 | Buehring | 34/254 |
| 6,751,886 | B2 | * | 6/2004 | Chang et al. | 34/96 |
| 6,769,197 | B1 | * | 8/2004 | Tai | 34/90 |
| 7,039,301 | B1 | * | 5/2006 | Aisenberg et al. | 392/380 |
| 7,437,833 | B2 | * | 10/2008 | Sato et al. | 34/90 |
| 2003/0150126 | A1 | * | 8/2003 | Chang et al. | 34/96 |
| 2006/0000110 | A1 | * | 1/2006 | Aisenberg et al. | 34/443 |
| 2006/0272170 | A1 | * | 12/2006 | Holmes | 34/275 |
| 2007/0079524 | A1 | * | 4/2007 | Sato et al. | 34/202 |
| 2008/0052952 | A1 | * | 3/2008 | Nelson | 34/554 |
| 2008/0216342 | A1 | * | 9/2008 | Kameishi et al. | 34/202 |
| 2008/0263889 | A1 | * | 10/2008 | Fukaya et al. | 34/267 |
| 2009/0000140 | A1 | * | 1/2009 | Collins | 34/89 |
| 2009/0119942 | A1 | * | 5/2009 | Aisenberg et al. | 34/418 |

FOREIGN PATENT DOCUMENTS

| | | | |
|---|---|---|---|
| JP | 11-283 | | 1/1999 |
| JP | 2001-104212 | | 4/2001 |
| JP | 2001-346715 | | 12/2001 |
| JP | 2002-034835 | | 2/2002 |
| JP | 2002-136448 | | 5/2002 |
| JP | 2004-261510 | * | 9/2004 |
| JP | 2005-160872 | | 6/2005 |
| JP | 2005-160874 | | 6/2005 |
| JP | 2005-168799 | | 6/2005 |
| JP | 2005-177130 | | 7/2005 |

* cited by examiner

HAND DRYING APPARATUS

TECHNICAL FIELD

The present invention relates to a hand drying apparatus that sanitarily dries wet hands after being washed by ejecting high-speed airflows.

BACKGROUND ART

Hand drying apparatuses that perform sanitary hand drying have been developed. These hand drying apparatuses blow moisture off by ejection of high-speed airflows to dry wet hands after being washed without wiping the hands with a towel or handkerchief. These types of hand drying apparatuses use kinetic energy of the high-speed airflows to blow moisture adhering to hands off. Therefore, collisions between opposite jet flows cause turbulence and produce noise.

In the technology disclosed in Patent Document 1, one nozzle is provided with slit-shaped ejecting holes and an opposite nozzle is provided with circular ejecting holes roughly arranged in respective lines. Therefore, turbulence caused by collisions between the opposite jet flows is reduced, thereby suppressing noise.

Patent Document 1: Japanese Patent Application Laid-Open No. 2001-104212

DISCLOSURE OF INVENTION

Problem to be Solved by the Invention

According to the Patent Document 1, although turbulence caused by collisions between jet flows can be reduced, circular jet flows having lower drying efficiency than slit-shaped jet flows are used on one side. Therefore, drying performance for palms and backs of hands becomes low, resulting in loss of usability.

The present invention has been devised in view of the circumstances, and an object thereof is to obtain a hand drying apparatus that can prevent noise without employing a complicated construction and realize high drying performance and excellent usability.

Means for Solving Problem

To solve the above problems and to achieve the above objects, according to an aspect of the present invention, a hand drying apparatus includes a main body box case that has a hand inserting portion formed in a concave shape at an upper portion; a high-pressure airflow generator that generates high-pressure airflows and is included in the main body box case; and a front side air nozzle and a back side air nozzle that eject the high-pressure airflows generated by the high-pressure airflow generator into the hand inserting portion and face each other, wherein the front side air nozzle and the back side air nozzle are formed by a plurality of slit-shaped ejecting holes arranged in a line, respectively, and both or any one of lengths and arranging intervals of the slit-shaped ejecting holes is different between a front side and a back side.

According to another aspect of the present invention, a hand drying apparatus includes a main body box case that has a hand inserting portion formed in a concave shape at an upper portion; a high-pressure airflow generator that generates high-pressure airflows and is included in the main body box case; and a front side air nozzle and a back side air nozzle that eject the high-pressure airflows generated by the high-pressure airflow generator into the hand inserting portion and face each other, wherein the front side air nozzle and the back side air nozzle are formed by a plurality of slit-shaped ejecting holes arranged in a line, respectively, and the slit-shaped ejecting holes on a front side are formed to be longer than the slit-shaped ejecting holes on a back side so that regions with different lengths where high-pressure airflows facing each other collide are formed on both sides of a region where the high-pressure airflows do not collide.

According to still another aspect of the present invention, a hand drying apparatus includes a main body box case that has a hand inserting portion formed in a concave shape at an upper portion; a high-pressure airflow generator that generates high-pressure airflows and is included in the main body box case; and a front side air nozzle and a back side air nozzle that eject the high-pressure airflows generated by the high-pressure airflow generator into the hand inserting portion and face each other, wherein the front side air nozzle and the back side air nozzle are formed by a plurality of slit-shaped ejecting holes arranged in a line, respectively, and an arranging interval of the slit-shaped ejecting holes on a front side are formed to be shorter than an arranging interval of the slit-shaped ejecting holes on a back side so that regions with different lengths where high-pressure airflows facing each other collide are formed on both sides of a region where the high-pressure airflows do not collide.

Effect of the Invention

According to the hand drying apparatus of the present invention, the front side air nozzle and the back side air nozzle are formed by a plurality of slit-shaped ejecting holes arranged in a line, respectively, and both or any one of lengths of the slit-shaped ejecting holes and arranging intervals of the slit-shaped ejecting holes is different between the front side and the back side. Accordingly, it is possible to obtain a hand drying apparatus that can prevent noise without employing a complicated construction and realize high drying performance and excellent usability.

According to another aspect of the present invention, the front side air nozzle and the back side air nozzle are formed by a plurality of slit-shaped ejecting holes arranged in a line, respectively, and the slit-shaped ejecting holes on the front side are formed to be longer than the slit-shaped ejecting holes on the back side so that regions with different lengths where high-pressure airflows facing each other collide are formed on both sides of a region where the high-pressure airflows do not collide. Accordingly, without employing a complicated construction, noise can be prevented, drying performance and usability are improved, and a palm and a back of a hand can be dried in a balanced manner.

According to still another aspect of the invention, the front side air nozzle and the back side air nozzle are formed by a plurality of slit-shaped ejecting holes arranged in a line, respectively, and the arranging interval of the slit-shaped ejecting holes on the front side are formed to be shorter than the arranging interval of the slit-shaped ejecting holes on the back side so that regions with different lengths where high-pressure airflows facing each other collide are formed on both sides of a region where the high-pressure airflows do not collide. Therefore, without employing a complicated construction, noise can be prevented, drying performance and usability are improved, and a palm and a back of a hand can be dried in a balanced manner.

EXPLANATIONS OF LETTERS OR NUMERALS

Figure 1:
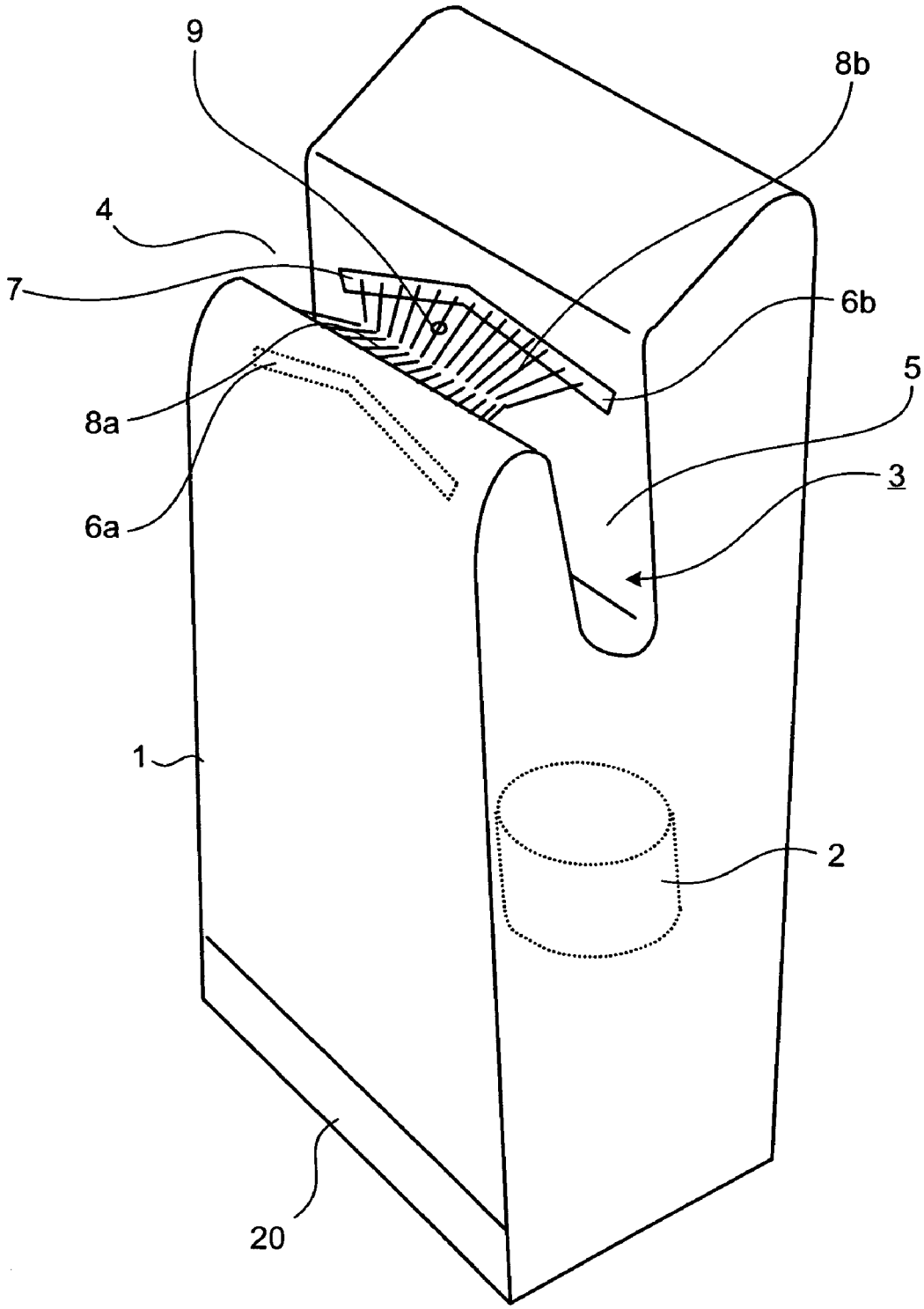
FIG. 1 is a perspective view of a hand drying apparatus according to an embodiment.

1 Main body box case
2 High-pressure airflow generator
3 Hand inserting portion
4 Hand inserting port
5 Drying space
6 Air nozzle
6*a* Air nozzle (front side)
6*b* Air nozzle (back side)
7 Slit ejecting hole
7*a* Slit-shaped ejecting hole (front side)
7*b* Slit-shaped ejecting hole (back side)
8*a*, 8*b* Film-like jet flow (high-speed airflow)
9 Hand detection sensor
10 Concave portion
11 Convex portion
12 Region where opposite jet flows do not collide
13, 14 Region where opposite jet flows collide (pressure fluctuation portion)
15 Wall face flow
16 Stagnation region
20 Drain tank
50 Circular hole

BEST MODE(S) FOR CARRYING OUT THE INVENTION

Exemplary embodiments of a hand drying apparatus according to the present invention are explained in detail below based on the drawings. Note that the present invention is not limited by these embodiments.

An embodiment of the present invention is explained with reference to FIG. 1 to FIG. 10. FIG. 1 shows an external appearance of a hand drying apparatus of the present embodiment. As shown in FIG. 1, this hand drying apparatus has a main body box case 1 that forms an outer sheath, having a hand inserting portion 3 on an upper portion. On an upper side of the main body box case 1, the hand inserting portion 3 is formed, which is a concave space formed by a hand inserting port 4 and a drying space 5 continued to the hand inserting port 4. The hand inserting portion 3 has a sink shape that is open at both sides and deep and inclined so that hands can be inserted and pulled out in a diagonally vertical direction, while both hands are aligned within a plane.

Inside the main body box case 1, a high-pressure airflow generator 2 is installed. High-pressure airflows generated by the high-pressure airflow generator 2 are guided to air nozzles 6*a* and 6*b* provided on a front wall face and a back wall face of the hand inserting portion 3 via an air duct (not shown) bifurcated to a front side and a back side of the hand inserting portion 3. In this hand drying apparatus, high-speed airflows are ejected from these opposite air nozzles 6*a* and 6*b* into the hand inserting portion 3 to blow moisture adhering to hands inserted in the hand inserting portion 3 into the drying space 5. The blown-off moisture is collected by a drain receptacle having an inclined bottom in the concave space, and the collected water is stored in a drain tank 20 via a drain outlet (not shown) and a cesspipe (not shown), at an inclined lower end. The drain tank 20 is detachably attached to the main body box case 1, and is provided with a detachable cover.

The high-pressure airflow generator 2 includes a direct current (DC) brushless motor (or a normal commutator motor or an induction motor), a drive circuit that drives this motor, and a turbo fan that is rotated by the DC brushless motor. In this embodiment, the high-pressure airflow generator 2 is attached below the hand inserting portion 3 of the main body box case 1, and is automatically driven by a control circuit (not shown). The air inlet side of the high-pressure airflow generator 2 faces an intake passage provided inside the main body box case 1 so as to suck in air from outside via an air inlet port at the end of the intake passage.

A hand detection sensor 9 is provided on the wall face forming the drying space 5. Based on a detection signal of the hand detection sensor 9, presence of a hand inserted in the drying space 5 via the hand inserting portion 3 is detected. The detection signal of the hand detection sensor 9 is inputted into the control circuit equipped with a microcomputer. When the control circuit judges that a hand has been inserted, the high-pressure airflow generator 2 is energized to make high-speed airflows to blow out from the air nozzles 6*a* and 6*b*.

In this hand drying apparatus, when both hands are inserted up to the vicinity of the wrists into the hand inserting portion 3 via the hand inserting port 4 while the hands are naturally aligned, the hand detection sensor 9 detects the hands. The high-pressure airflow generator 2 starts in response to processing of the control circuit. High-speed airflows 8*a* and 8*b* are blown into the hand inserting portion 3 from the air nozzles 6*a* and 6*b* and hit the palms and backs of the inserted hands to blow moisture adhering to the hands toward the bottom side of the hand inserting portion 3. Furthermore, by vertically moving the hands within the hand inserting portion 3, waterdrops adhering to the entire hands is completely removed so that the hands are dried. After drying the hands, when the hands are completely pulled out from the hand inserting portion 3, the hand detection sensor 9 detects this and the high-pressure airflow generator 2 stops. Waterdrops blown off from the hands adhere to the inner wall face of the hand inserting portion 3, but successively flow down to the bottom via the drain port and the cesspipe and are then stored in the drain tank 20.

Figure 2:
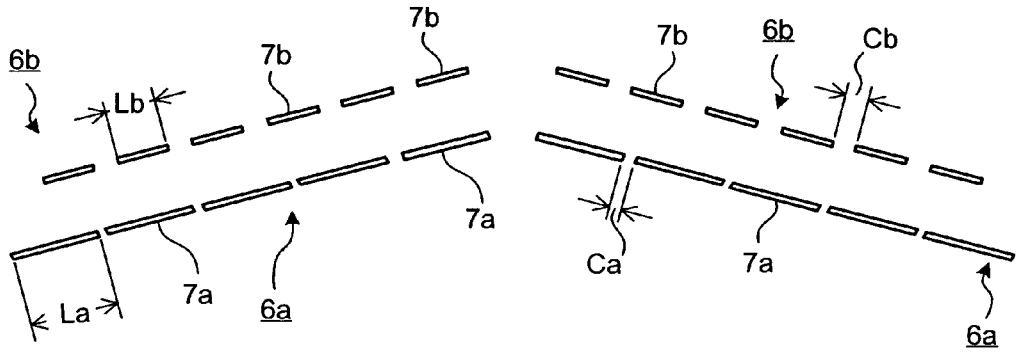
FIG. 2 is a front view of the entire construction of air nozzles of the hand drying apparatus according to the embodiment.

Next, the air nozzles 6*a* and 6*b* that are main parts of the present embodiment are explained in detail with reference to FIG. 2 and FIG. 3. FIG. 2 is a conceptual front view from the front side of the air nozzle 6*a* on the front side and the air nozzle 6*b* on the back side disposed oppositely to each other. Both the air nozzles 6*a* and 6*b* of the present embodiment have a plurality of slit-shaped ejecting holes 7*a* and 7*b* arranged in a line, respectively, at both the front side and the back side. In this case, a line form bent at the center is employed. The slit-shaped ejecting holes 7*a* and 7*b* are inclined downward so that the high-speed airflows 8*a* and 8*b* are ejected slightly downward.

The air nozzle 6*a* on the front side and the air nozzle 6*b* on the back side are formed so that, as shown in FIG. 2, lengths La of the slit-shaped ejecting holes 7*a* on the front side and lengths Lb of the slit-shaped ejecting holes 7*b* on the back side are different, and arranging intervals Ca between the slit-shaped ejecting holes 7*a* on the front side and arranging intervals Cb between the slit-shaped ejecting holes 7*b* on the back side are different. In this case, the lengths of the slit-shaped ejecting holes are set so as to satisfy La>Lb, and the arranging intervals of the slit-shaped ejecting holes are set so as to satisfy Ca<Cb. At the air nozzle 6*a* on the front side, the lengths La and the arranging intervals Ca of the slit-shaped ejecting holes 7*a* are the same, and at the air nozzle 6*b* on the back side, the lengths Lb and the arranging intervals Cb of the slit-shaped ejecting holes 7*b* are the same.

Figure 3:
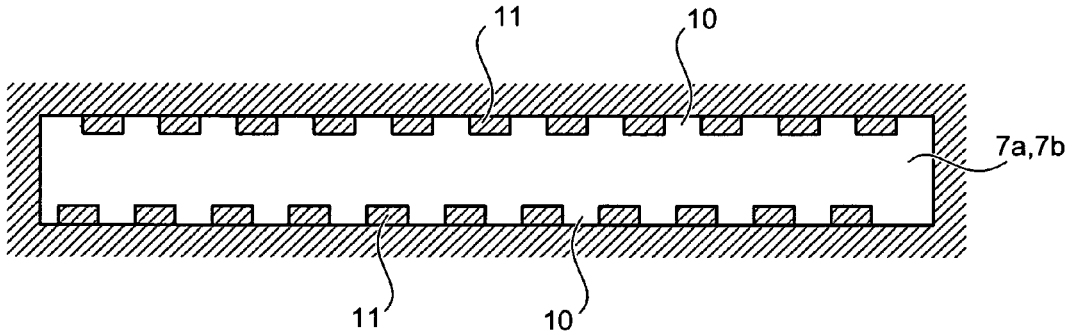
FIG. 3 is a sectional view of a construction of slit-shaped ejecting holes of the hand drying apparatus according to the embodiment.

FIG. 3 is a sectional view of one slit-shaped ejecting hole 7*a* or 7*b*. On the inner side of the wall face forming the slit-shaped ejecting holes 7, a plurality of concave portions 10 (and convex portions 11) extending in the airflow directions are formed, and these generate small turbulence of the airflows. In this case, as shown in FIG. 3, on the inner side of the upper and lower wall faces forming the slit-shaped ejecting holes 7, a plurality of concave portions 10 and convex portions 11 are formed.

Figure 4:
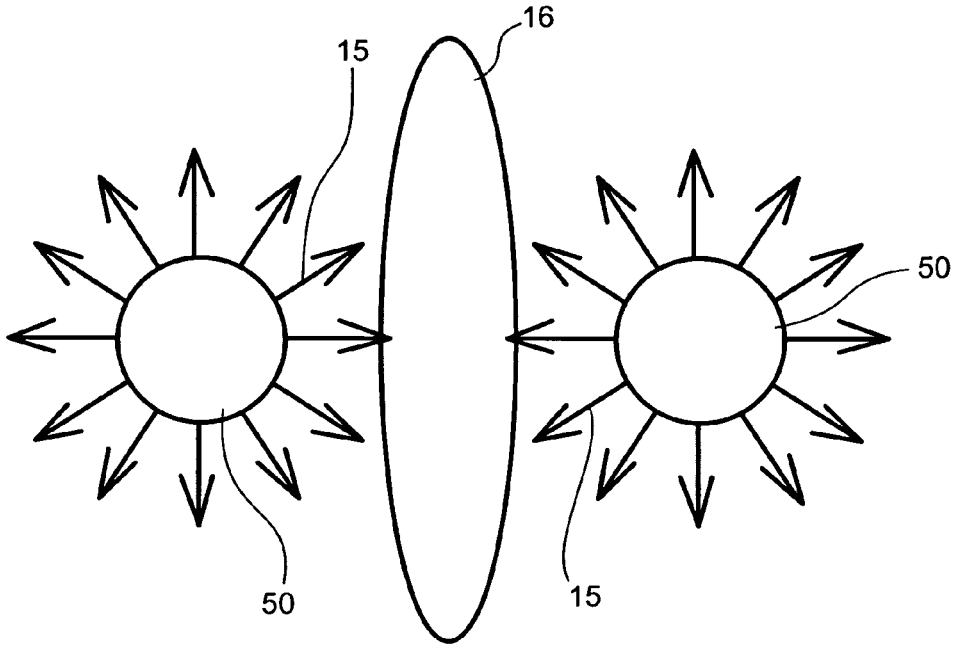
FIG. 4 is a conceptual view of motions of colliding jet flows in a conventional technology.

To blow moisture adhering to the hands off, it is more advantageous that jet flows intensively act on the hand surfaces. It is generally known that the force of the jet flows can be evaluated based on their momentum, that is, the product of the air density, flow volume, and flow velocity. However, the force of colliding jet flows immediately after colliding with the hands directly acts on the moisture adhering to the hands. As shown in FIG. 4, when the nozzles are formed by a plurality of circular holes 50 arranged in line, the colliding jet flows ejected from the circular holes 50 become wall face flows 15 that radially spread, so that the colliding jet flows further collide with adjacent wall face flows 15 and forms a large stagnant region 16. In this stagnant region 16, a force that makes the moisture adhering to the hands to be held on the hands acts, so that moisture streaks remain in the moving direction of hands when the hands are inserted or pulled out.

Figure 5:
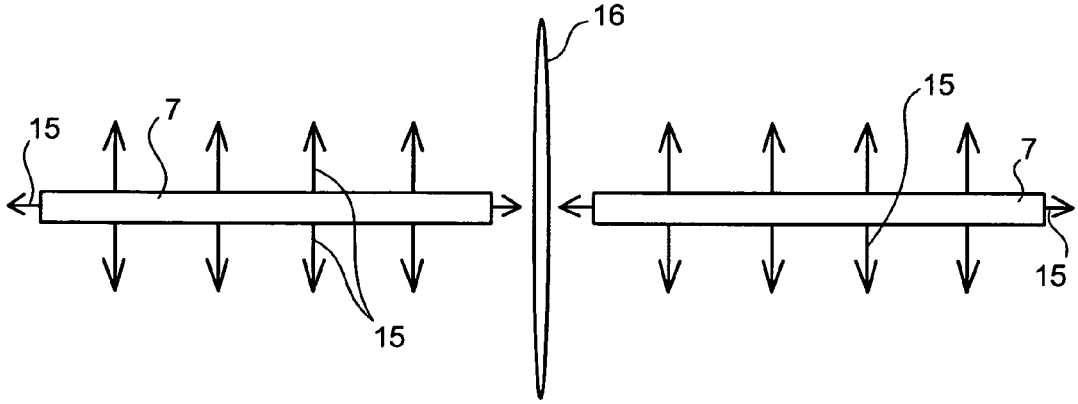
FIG. 5 is a conceptual view of motions of colliding jet flows of the hand drying apparatus according to the embodiment.

On the other hand, at the slit-shaped ejecting holes 7, in order to prevent deformation of nozzles due to internal pressure and suppress turbulence inside the nozzles, it is typical to properly divide the length of the ejecting holes 7. As a dividing method, a plurality of separate nozzles is formed or ribs to become partitions are installed inside a single nozzle, and both cases have equivalent effects. In the case of colliding jet flows obtained by using the divided slit-shaped ejecting holes 7 as shown in FIG. 5, wall face flows 15 perpendicular to the length of the ejecting holes are formed. This is because the streams of the airflows in the longitudinal direction of the ejecting holes are regulated. The wall face flows 15 are formed in the longitudinal direction only at the longitudinal ends, where they are not regulated. Therefore, in the case of the slit-shaped ejecting holes 7, the stagnation region 16 generated between the adjacent ejecting holes is much smaller compared to in the case of the circular holes 50. As a result, a smaller amount of moisture remains on the hands compared to in the case of the circular holes 50, realizing high drying efficiency.

Figure 6:
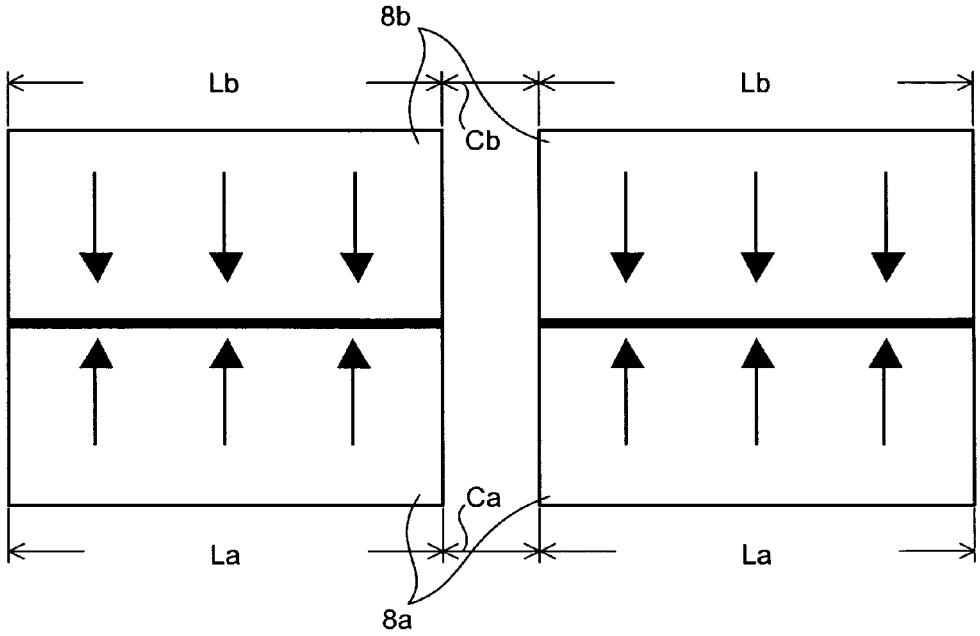
FIG. 6 is a conceptual view of an arrangement of film-like jet flows according to the embodiment.
Figure 7:
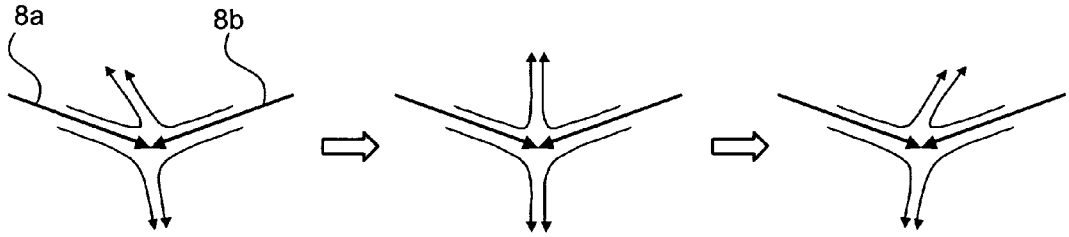
FIG. 7 is a conceptual view of motions of colliding jet flows.

However, in the case where the slit-shaped ejecting holes 7 face each other, as shown in FIG. 6, when film-like jet flows 8*a* and 8*b* ejected from the slit injecting holes 7 collide forthrightly inside the hand inserting portion 3, turbulence at the collisions point and loud noise due to turbulence occur. As shown in FIG. 7, when the jet flows 8*a* and 8*b* collide at a slight angle, in particular, at the upper side of the collisions point, one air flow is significantly bent and split, and causes a momentum change according to the bending angle, so that a jet stream force that strongly pushes the other stream back is generated. Once the streams are pushed back, the streams undergo a balanced state, and are turned toward the opposite direction. This series of self-excited vibrations become a pressure fluctuation, fluctuate the split streams below the collisions point, propagate to the entirety of the film-like jet flows shown in FIG. 6, and cause large-scale turbulence having jet stream lengths and a pressure fluctuation. Since the pressure fluctuation produces loud noise, this makes users uncomfortable. If the fluctuation becomes larger in scale, the pressure fluctuation propagates in jet stream directions inside the jet flows and may reach the high-pressure airflow generator 2 via the air nozzle 6 on the upstream side. In this case, the pressure to be discharged from the high-pressure airflow generator 2 also fluctuates. Therefore, this fluctuation links to the collisions point of the jet stream from the air nozzle 6, forms a feedback loop over the entirety of the discharge system, and may cause pulsatory motion involving a large-scale pressure fluctuation and damage the high-pressure airflow generator 2.

Figure 8:
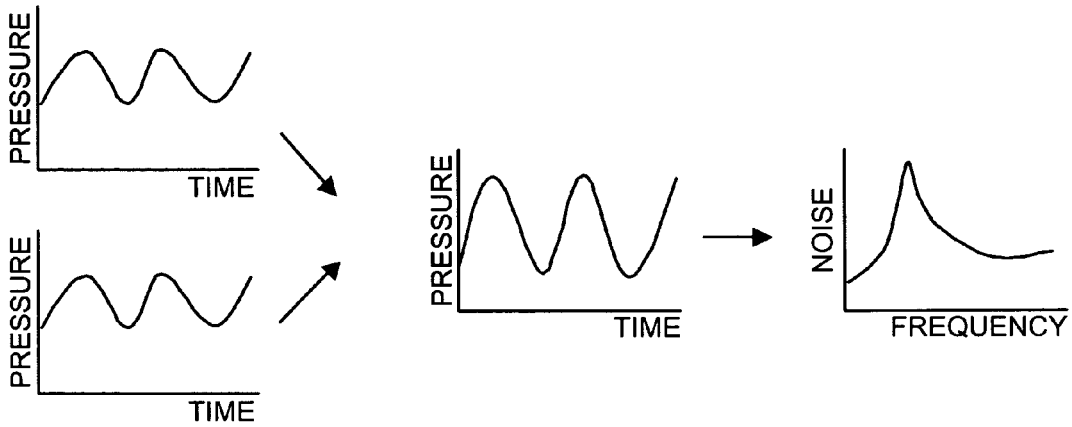
FIG. 8 depicts waveform charts of pressures and noises in the conventional technology.

Particularly, as shown in FIG. 6, when the lengths of the slit-shaped ejecting holes 7*a* and 7*b* facing each other are La=Lb and are equal between adjacent holes, and the arranging intervals of the slit-shaped ejecting holes 7*a* and 7*b* are Ca=Cb, as shown in FIG. 8, the pressure waveform is amplified and uncomfortable noise with high peaks occur.

Figure 9:
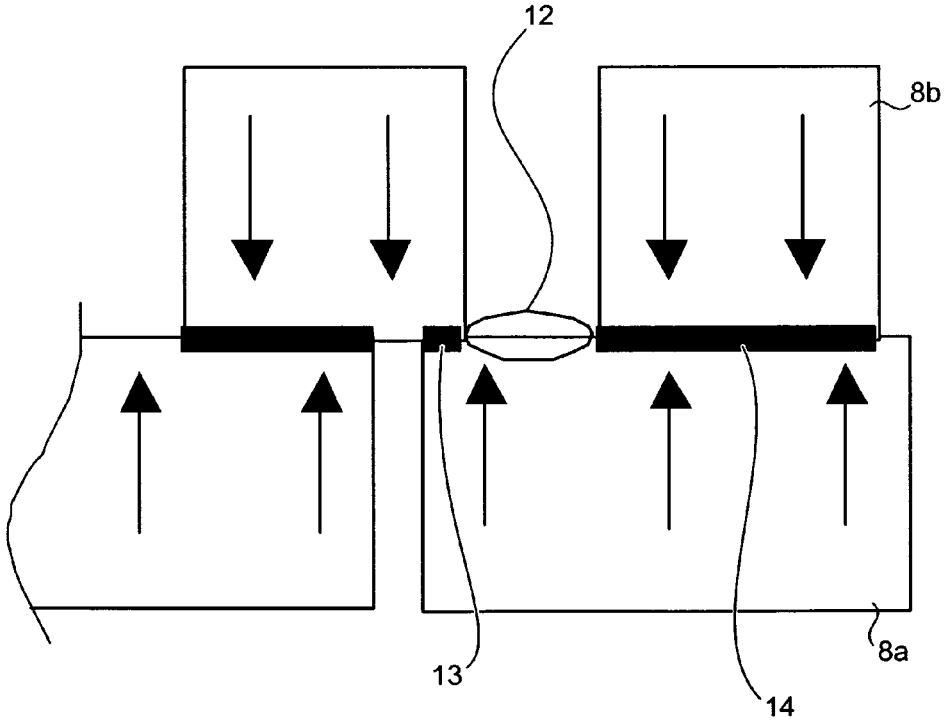
FIG. 9 is a conceptual view of an arrangement of film-like jet flows of the hand drying apparatus according to the embodiment.
Figure 10:
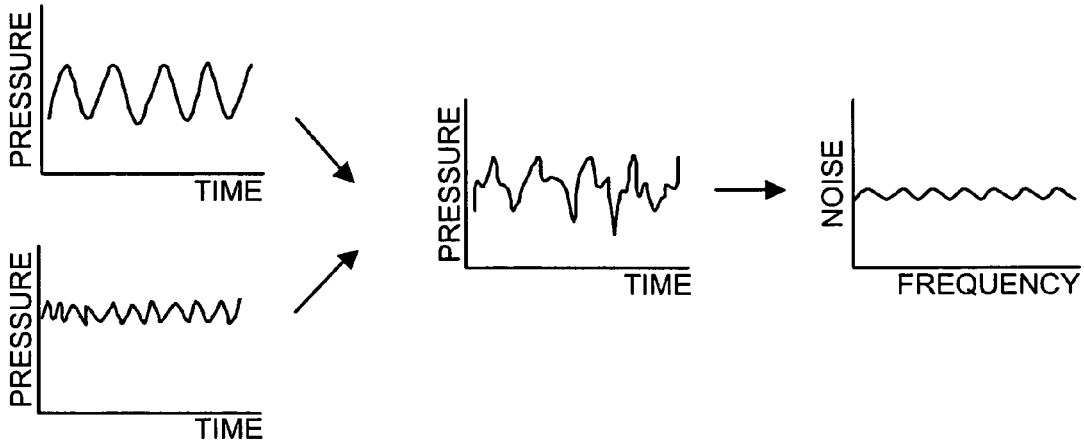
FIG. 10 depicts waveform charts of pressures and noises of the hand drying apparatus according to the embodiment.

In order to restrain the pressure fluctuation, in the present embodiment, as described above, the slit-shaped ejecting holes 7 are formed so that the lengths La of the slit-shaped ejecting holes 7*a* on the front side and the lengths Lb of the slit-shaped ejecting holes 7*b* on the back side are different, and the arranging intervals Ca between the slit-shaped ejecting holes 7*a* on the front side and the arranging intervals Cb between the slit-shaped ejecting holes 7*b* on the back side are different. With this construction, as shown in FIG. 9, regions 13 and 14 with different lengths where facing jet flows collide are formed on both sides so as to sandwich a region 12 where the facing jet flows do not collide. Therefore, the pressure fluctuating portions 13 and 14 with shifted phases are alternately sandwiched by the regions 12 that have no pressure fluctuations, so that the noise is smoothed and occurrence of noise can be restrained, as shown in FIG. 10.

In the present embodiment, as described above, the length La of the slit-shaped ejecting holes 7*a* on the front side is set longer than the length Lb of the slit-shaped ejecting holes 7*a* on the back side. Generally, the palm sides of hands have a large amount of moisture in the horny layer of the skin, and are therefore more difficult to dry than the back sides of hands. Therefore, by increasing the force of the jet stream on the palm sides, the palms and backs of hands can be dried in a balanced manner. The air nozzle 6*a* on the front side faces the palm sides of hands, so that when the air nozzle 6*a* on the front side is formed so as to have slit ejecting holes longer than those of the air nozzle 6*b* on the back side, the palm and back of hands can be dried in a balanced manner. However, when the length La of the slit-shaped ejecting holes 7*a* on the front side is set longer than the length Lb of the slit-shaped ejecting holes 7*b* on the back side, as explained in FIG. 9, it is preferable to form the slit-shaped ejecting holes 7*a* on the front side to be longer than the slit-shaped ejecting holes 7*b* on the back side so that the regions 13 and 14 with different lengths where high-pressure airflows facing each other collide are formed on both sides so as to sandwich the region 12 where the high-pressure airflows do not collide, thereby obtaining the effect of restraining the occurrence of noise.

In addition, in the present embodiment, as described above, the arranging intervals Ca between the slit-shaped ejecting holes 7*a* on the front side is set shorter than the arranging intervals Cb of the slit-shaped ejecting holes 7*b* on the back side. When the arranging interval between the ejecting holes is formed to be shorter on the front side than on the back side, the jet flows hit a wider area of the palm sides, so that the palms and the backs of hands can be dried in a balanced manner. Preferably, the intervals between the ejecting holes are set to 1 mm to 3 mm on the front side and 4 mm to 6 mm on the back side in terms of both drying performance and noise. However, when the arranging intervals Ca between the slit-shaped ejecting holes 7*a* on the front side are set shorter than the arranging intervals Cb of the slit-shaped ejecting holes 7*b* on the back side, as explained in FIG. 9, it is preferable to form the arranging intervals Ca between the slit-shaped ejecting holes 7*a* on the front side to be shorter than the arranging intervals Cb between the slit-shaped ejecting holes 7*b* on the back side so that the regions 13 and 14 with different lengths where high-pressure airflows facing each other collide are formed on both sides so as to sandwich the region 12 where the high-pressure airflows do not collide, thereby obtaining the effect of restraining the occurrence of noise.

Furthermore, in the present embodiment, as shown in FIG. 3, a plurality of irregularities are formed inside the slit ejecting holes 7. The irregularities actively generate small turbulence inside the collision region so as to prevent pulsatory motions with the scale of the collision width in the collisions region. The shape of an arrangement for generating the turbulence is not especially limited, and it is also possible to form only concave portions.

Furthermore, in this embodiment, the length La of the slit-shaped ejecting holes 7*a* on the front side and the length Lb of the slit-shaped ejecting holes 7*b* on the back side are different, and the arranging interval Ca between the slit-shaped ejecting holes 7*a* on the front side and the arranging interval Cb between the slit-shaped injecting holes 7*b* on the back side are different. However, it is also possible that only the length La of the slit-shaped ejecting holes 7*a* on the front side and the length Lb of the slit-shaped ejecting holes 7*b* on the back side are different, or only the arranging interval Ca between the slit-shaped ejecting holes 7*a* on the front side and the arranging interval Cb between the slit-shaped ejecting holes 7*b* on the back side are different.

INDUSTRIAL APPLICABILITY

As described above, a hand drying apparatus according to the present invention is useful for sanitarily drying wet hands after being washed by ejecting high-speed airflows.

The invention claimed is:

1. A hand drying apparatus comprising:

a hand inserting portion having a concave shape including a front inner wall facing a back inner wall;

an airflow generator that generates high-pressure airflows; and a first air nozzle and a second air nozzle that inject the high-pressure airflows generated by the airflow generator to the hand inserting portion, wherein the first air nozzle is provided on the front inner wall and the second air nozzle is provided on the back inner wall, wherein the first air nozzle includes a plurality of slit-shaped first holes arranged in a first line, each having a first length along the first line, and a plurality of first intervals, each having a third length along the first line, between the first holes, the second air nozzle includes a plurality of slit-shaped second holes arranged in a second line parallel to and opposite the first line, each having a second length along the second line, and a plurality of second intervals, each having a fourth length along the second line, between the second holes, and the first length and the second length are different, or the third length and the fourth length are different, and the first and second air nozzles are configured such that the high-pressure airflows injected from the first air nozzle and the high-pressure airflows injected from the second air nozzle collide at a plurality of first regions the high-pressure airflows injected from the first air nozzle and the high-pressure airflows injected from the second air nozzle do not collide at at least one second region the first regions have different lengths, and the at least one second region is between the first regions.

2. The hand drying apparatus according to claim 1, wherein the first length and the second length are different, and the third length and the fourth length are different.

3. The hand drying apparatus according to claim 1, wherein a plurality of concave portions is formed on inner walls of the first holes and second holes.

4. The hand drying apparatus according to claim 1, wherein a plurality of convex portions is formed on inner walls of the first holes and second holes.

5. The hand drying apparatus according to claim 1, wherein the first length is longer than the second length.

6. The hand drying apparatus according to claim 1, wherein the third length is shorter than the fourth length.

7. A hand drying apparatus comprising:

a main body box case Including a hand inserting portion formed concave at a top portion of the main body box case;

a high-pressure airflow generating device that is installed in the main body box case and generates a high-pressure airflow; and a front air nozzle portion and a back air nozzle portion disposed opposite to each other, through which the high-pressure airflow generated by the high-pressure airflow generating device is ejected into the hand inserting portion, the front air nozzle portion formed of a plurality of first slit-shaped holes arranged in a first line, the second air nozzle portion formed of a plurality of second slit-shaped holes arranged in a second line opposite to the first line, an interval between two adjacent first slit-shaped holes of the plurality of first slit-shaped holes overlapping one of the plurality of second slit-shaped holes along the first and second lines, a first overlap length between one of the two adjacent first slit-shaped holes and the one of the plurality of second slit-shaped holes being different from a second overlap length between an other one of the two adjacent first slit-shaped holes and the one of the plurality of second slit-shaped holes.

8. The hand drying apparatus according to claim 7, wherein a first length of each of the plurality of first slit-shaped holes is different from a second length of each of the plurality of second slit-shaped holes, or a first interval between each two adjacent first slit-shaped holes is different from a second interval between each two adjacent second slit-shaped holes.

9. The hand drying apparatus according to claim 7, wherein a first length of each of the plurality of first slit-shaped holes is different from a second length of each of the plurality of second slit-shaped holes, and a first interval between each two adjacent first slit-shaped holes is different from a second interval between each two adjacent second slit-shaped holes.

10. The hand drying apparatus according to claim 7, wherein a first length of each of the plurality of first slit-shaped holes is longer than a second length of each of the plurality of second slit-shaped holes.

11. The hand drying apparatus according to claim 7, wherein a first interval between each two adjacent first slit-shaped holes is shorter than a second interval between each two adjacent second slit-shaped holes.

* * * * *